US005351399A

United States Patent [19]

Neuhöffer et al.

[11] Patent Number: 5,351,399

[45] Date of Patent: Oct. 4, 1994

[54] METHOD FOR FORMING GROOVES IN ROLL SURFACES

[75] Inventors: Hans-Friedrich Neuhöffer; Wolfram Rittweger; Erich Vomhoff, all of Königsbronn, Fed. Rep. of Germany

[73] Assignee: Schwäbische Huttenwerke GmbH, Aalen-Wasseralfingen, Fed. Rep. of Germany

[21] Appl. No.: 738,368

[22] Filed: Jul. 31, 1991

Related U.S. Application Data

[63] Continuation-in-part of Ser. No. 561,426, Aug. 1, 1990, abandoned.

[30] Foreign Application Priority Data

Aug. 3, 1989 [DE] Fed. Rep. of Germany ..... 3925787

[51] Int. Cl.[5] ..... A01B 29/00; A01G 1/12

[52] U.S. Cl. ..... 29/895.31; 29/895.3

[58] Field of Search ..... 29/121.1, 121.2, 121.3, 29/121.4, 121.5, 121.6, 121.7, 121.8, 895.3, 895.31; 219/121.68, 121.69

[56] References Cited

U.S. PATENT DOCUMENTS

| | | | |
|---|---|---|---|
| 3,597,578 | 8/1971 | Sullivan | 219/121 L |
| 4,015,100 | 3/1977 | Gnanamuthu et al. | 29/121.1 X |
| 4,200,382 | 4/1980 | Friedman | 29/121.1 X |
| 4,443,684 | 4/1984 | Sakuragi et al. | 219/121.68 |
| 4,628,179 | 12/1986 | Crahay | 219/121.68 |
| 4,734,729 | 3/1988 | Hertzel et al. | 29/121.1 X |
| 4,806,731 | 2/1989 | Bragard et al. | 219/121.68 X |
| 4,944,826 | 7/1990 | Zollman et al. | 219/121.68 X |
| 4,947,023 | 8/1990 | Minamida et al. | 219/121.68 |
| 4,996,113 | 2/1991 | Hector et al. | 29/121.4 X |
| 5,072,091 | 12/1991 | Nagata et al. | 219/121.69 X |

FOREIGN PATENT DOCUMENTS

| | | | |
|---|---|---|---|
| 0282887 | 9/1988 | European Pat. Off. | |
| 1294805 | 5/1969 | Fed. Rep. of Germany | |
| 3923719A | 11/1990 | Fed. Rep. of Germany | |
| 2408423 | 6/1979 | France | |
| 2049102 | 12/1980 | United Kingdom | 29/121.1 |

OTHER PUBLICATIONS

Lasers: A bright spot in the Aerospace industry, by Dick Nelson, Aug. 1986; 29/121.1; *Production Eng.*

*Primary Examiner*—Timothy V. Eley

*Attorney, Agent, or Firm*—Armstong, Westerman, Hattori, McLeland & Naughton

[57] ABSTRACT

The present invention is a method for forming grooves in rolls which are suitable for working web-like materials, wherein a laser source directs a laser beam and an aligned conduit directs a pressurized gas jet onto the roll surface, the roll material thus being removed in a sharply defined area and a groove thereby being formed.

23 Claims, 2 Drawing Sheets

METHOD FOR FORMING GROOVES IN ROLL SURFACES

This is a continuation-in-part of application Ser. No. 561,426 filed Aug. 1, 1990 now abandoned.

BACKGROUND OF THE INVENTION

1. Field of the Invention

The present invention relates to a method for forming drainage grooves in the surface of a roll which is suitable for processing web-like materials, for example, paper, and a roll machined by said method.

2. Description of the Prior Art

Hereinafter, the procedure with regard to the making of paper will be discussed in more particular detail.

In modern paper making machines a water/fiber mixture having a solid content of about 2% is applied to an endlessly revolving screen. A large part of the water flows through the screen openings so that after a short time, the solid component has increased to about 50%. In the further course of the process, the paper web still of low strength is transferred to an endlessly revolving felt. For further dewatering, the paper web and felt are conducted jointly through the so-called wet press. Such presses are two-roll or multi-roll mills consisting, for example, of a stone roll with one or more pressing rolls. Whereas the stone roll is smooth on the paper side, the pressing rolls are usually grooved on the felt side. Due to the pressure in the roll nip, a further portion of the water is forced into the roll groove and on further rotating of the pressing rolls centrifuged out again. Grooved pressing rolls thus make a decisive contribution to dewatering and consequently, reduce the heating power to be applied in the dry section for further drying the paper.

For corrosion reasons, grooved rolls are made with a special steel covering.

Since this material is very tough and the necessary grooves relatively narrow and deep and although mechanical milling of the grooves is possible, it is very complicated and due to the tool consumption, very expensive.

An alternative method of applying a grooved special steel covering resides in wrapping a specially formed special steel band around a prepared roll body. The profile of this band or strip has a height of about 12 mm and in the region of the groove, a thickness corresponding to the web between the grooves.

At the bottom, the profile is as wide as the web plus groove. When the special steel strip is now coiled under tensile stress and application of pressure onto the roll body, a helically grooved roll surface is formed. Since the starting material is expensive, this method is also very expensive.

Moreover, if after a part of the roll has already been wrapped, the special steel strip tears, the already wrapped part must be freed of the strip again and the winding with a new strip started from the beginning.

SUMMARY OF THE INVENTION

The invention therefore has as its object the elimination of the disadvantages of the prior art outlined above and in particular, to propose a method with which various groove forms can be produced in the surface of such a roll without great expenditure.

The invention therefore proposes in a method for forming grooves in the surface of a roll for processing web-like materials, in particular paper, the improvement that the grooves are formed using a laser beam.

Advantageous forms of embodiment of the method according to the present invention are defined by the feature of the subsidiary claims.

According to the present invention, the focused light beam of a laser source is directed onto the surface of a roll to be grooved. The laser beam very rapidly melts a restricted area of the surface. By blowing the melt point by means of a directed pressurized gas jet, the molten material is blown away. If the roll is now turned, a groove is formed. If the laser source is simultaneously moved in the axial direction of the roll, a helical groove is formed.

By means of the various adjustable parameters of this method, the shape, depth and path of the groove can be adjusted in the manner, for example, necessary for optimizing the dewatering effect of the press roll given by way of example.

As a rule, it is advantageous to generate a protective gas atmosphere preventing, for example, oxidation of the edge regions in the area to be worked at the surface of the roll; thereby, enabling the edge quality of the grooves to be improved. For this purpose, the pressurized gas jet need consist only of inert gases.

In order to reduce the cooling effect of the pressurized gas jet, it is advantageous to heat the pressurized gas.

It is also possible to assist the action of the laser beam by oxidizing gas mixtures. For this purpose, oxygen is admixed with the gas for the pressurized gas jet. The oxidizing gas mixture burns part of the metal and thus, generates additional melting energy.

The grooves should under no circumstances be burnt deeper than 10 mm into the roll cover. Preferably, the groove depth lies in a range between 3 and 7 mm, a groove depth of 5 mm usually being employed.

For certain uses, it may be advantageous to cause the laser beam to strike the roll surface to be worked at an inclined angle. If, for example, the grooves are to intersect, then in the region of the intersecting grooves, the penetration depths of the laser beam into the material would almost summate so that at the groove-intersection points, real holes would be formed. If, however, the laser beam is allowed to impinge on the roll surface at an inclined angle, this effect is largely eliminated. Material-specific reflections of the laser beam may also be positively influenced by angular impinging of the laser beam on the roll surface. In addition, it is easier to remove the vaporized metal from the roll surface which influences very positively the working rate and the groove quality.

The grooves formed using the laser beam in the roll cover should not be wider than 1 mm, preferably 0.3 to 0.7 mm. As a rule, grooves with a width of 0.5 mm are formed.

In the present case, the use of a $CO_2$ laser is particularly expedient because the technology thereof is sophisticated and proven. Other laser types may also be employed.

Generally, however, laser with energy densities of at least 1 KW, preferably at least 5 KW, should be used for carrying out the method according to the invention.

For forming grooves in the roll surface, the roll to be worked on is disposed in a holder in which the roll can be rotated with a specific uniform velocity about its axis of a rotation. In order to obtain the desired groove depth, the laser beam must have a specific lingering or residence duration in a defined area on the roll surface. This necessary residence duration is taken into account by a correspondingly set rotational speed of the roll. The necessary residence duration can, of course, also be regulated via the energy density of the laser beam.

In order to obtain a helical groove on the roll surface, the operating laser source or the laser beam may be moved along the roll to be worked on. The velocity with which this movement is carried out gives, in conjunction with the rotational velocity of the roll, a certain pitch for the helical groove to be formed.

It is conceivable that under certain conditions, it may be expedient to allow only the roll or alternatively only the laser source or the laser beam to carry out the necessary movements for configuring the groove.

The pitch of the helical groove should be dimensioned so that the distance between two adjacent groove channels is not greater than 10 mm and preferable amount to 5 mm.

For certain uses, it may be advantageous to form in the roll surface not only a helical groove, but, for example, several oppositely running helical grooves which along their path frequently intersect.

It would also be conceivable to form a plurality of radially closed grooves which are interconnected via grooves extending parallel to the roll axis on the roll surface.

It is conceivable to simultaneously introduce two or more parallel grooves by beam splitting to thus shorten the processing time.

BRIEF DESCRIPTION OF THE DRAWINGS

The invention will be described hereinafter in more detail with the aid of the drawings of an example of embodiment from which further advantages features are apparent. In the drawings.

DESCRIPTION OF THE PREFERRED EMBODIMENT

Figure 1:
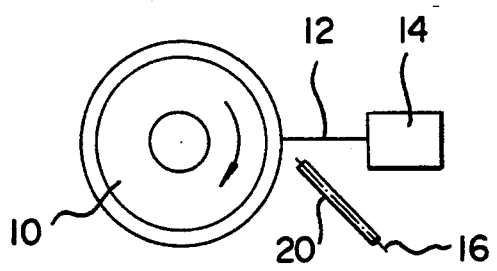
FIG. 1 shows an arrangement for carrying out the method according to the invention in cross-section.

FIG. 1 shows schematically a basic arrangement for carrying out the method according to the invention. A roll 10 which is mounted in a holder rotatably and/or displaceably in the direction of the arrow is processed by means of a laser beam 12. The laser beam 12 is generated by a laser source 14. Preferably, a $CO_2$ laser is used as a laser source 14. Via a supply tube or a hollow needle 20 a protective gas atmosphere or an oxidizing gas atmosphere can be generated in the area momentarily to be processed on the roll surface. If the assisting gas is directed with high pressure to the surface of the roll to be worked on, the gas stream will simultaneously blow the molten, vaporized or burnt materials from the resulting groove and from the processing area of the laser beam 12 on the roll surface.

The roll 10 is turned and simultaneously axially displaced with a certain velocity. By the rotational velocity of the roll, the residence or lingering duration of the laser beam 12 can at a given point of the roll surface be influenced. In other words, for a given set laser-beam-power density of the laser source 14, the depth of the drainage grooves in the roll surface of the roll 10 can be defined by varying the rotational velocity. For a given power of the laser source 14, the roll 10 should not be turned so slowly that the groove depth becomes greater than 10 mm. Preferably, the groove depth should lie between 3 and 7 mm, and, as a rule, should be 5 mm.

The laser beam 12 should act on the surface of the roll 10 over a width of at the most 1 mm, preferably 0.3 to 0.7 mm. As a rule, the laser beam should vaporize the material of the roll surface over a width of 0.5 mm and thus, generate a groove width of 0.5 mm.

By the displacement of the roll in the axial direction, the lateral distance between two adjacent groove channels is defined. The maximum axial displacement velocity of the roll 10 should not form a distance between two adjacent groove channels 18 greater than at most 10 mm, preferably about 5 mm.

Of course, the groove depth can also be set in the intensity of the laser beam 12 is increased or decreased while the roll 10 is rotated with constant velocity.

All the movements may be performed solely by the roll 10 or alternatively, solely by the laser (or laser beam). Preferably, the roll 10 will execute the rotational movement while the laser beam 12 or laser source 14 will execute the axial movement along the axis of the roll 10.

Figure 2:
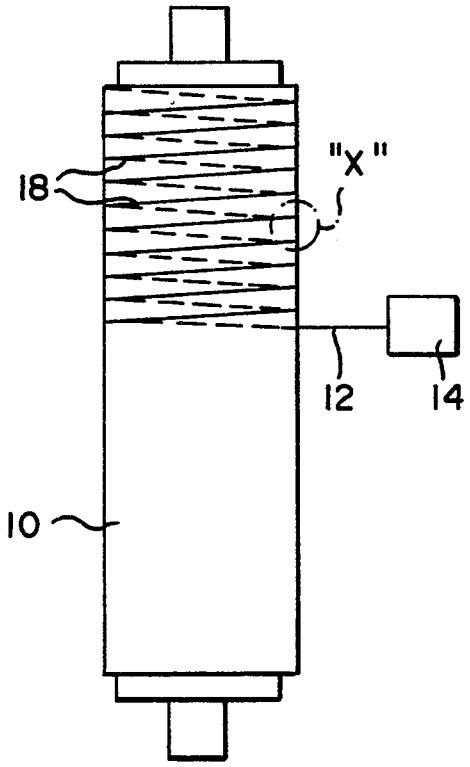
FIG. 2 shows the same arrangement as FIG. 1, but in plan view.

FIG. 2 shows a schematic basic illustration of the arrangement according to FIG. 1 but in plan view. The helical path of the groove 18 can be clearly seen. The groove 18 may, however, also consist of oppositely running helical grooves 18 which intersect. With this configuration, the laser 14 is adjusted so that the laser beam 12 strikes the roll surface perpendicularly. Depending on the use, the laser beam 14 may also be adjusted in such a manner that the laser beam 12 strikes the roll surface at a specific angle between 90° and approximately 0°.

Figure 3:
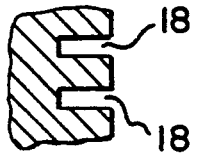
FIG. 3 shows to a larger scale the detail "X" of a roll surface in which grooves are formed by using the method according to the invention.

FIG. 3 shows, in an enlarged scale, the detail "X" of FIG. 2. The grooves 18 which have been made by the method according to the invention can be seen clearly. By a corresponding additional inclination angle of the laser beam, the drainage grooves 18 may also be given a path which is not perpendicular to the surface of the roll.

Figure 4:
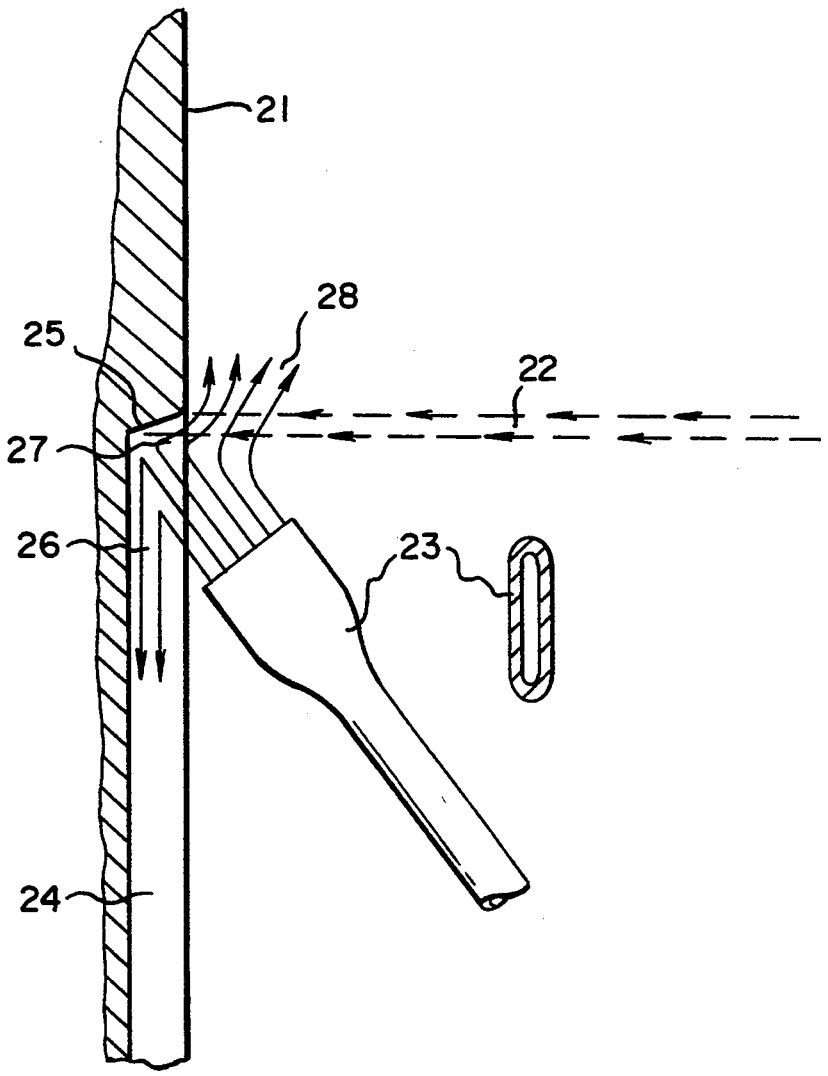
FIG. 4 is a sketch to illustrate a principle of the invention for forming grooves.

FIG. 4 illustrates a principle of this invention for forming grooves. As illustrated in FIG. 4, a laser beam 22 is used for melting the roll material at the surface of the roll 21 to a depth of 3 mm to 7 mm, and a width of 0.3 mm to 0.7 mm. This laser beam 22 is directed onto the endface 25 of the groove 24 to be formed. Simultaneously, a gas jet is directed onto the endface 25 from a split-shaped nozzle 23, wherein the gas jet completely removes the molten roll material both from the groove 24 and the surface of the roll 21.

As can further be seen in FIG. 4, a first part 26 of the gas jet is deflected from the endface 25 into the groove 24 already formed. The reactive force created by the deflection drives a second part of the gas jet (namely, the gas jet 27) upwardly out of the groove; thereby, transporting by pressure and friction the molten roll material into the second part of the gas jet (i.e., the gas jet 28 blasting the roll material away from the roll 21).

In the above-discussed structural arrangement and method of this invention, the operating parameters thereof are hereinafter set forth.

The surface material of the roll is a non-corrosive steel having the following composition: $C<=0.1$;

Si<=1.0; Mn<=2.0; Cr=16.5-17.5; Mo=2.25; Ni=10.5-13.5; and Fe as the balance.

The laser power is in the range from 5 to 6 KW. The focal distance of the laser beam is 300 mm. The focus of the laser beam is set to a point 1 to 3 mm above the surface of the roll. The operation speed, namely the speed of forming the groove, is set to a value in the range from 1.2 to 1.6 m/min.

The blowing gas has the following composition: 91 Vol. % argon; 5 Vol. % carbon dioxide; and 4 Vol. % oxygen.

A gas amount in the range from 55 to 60 $Nm^3$/min. having a blowing pressure of about 10 bar is used. The gas jet impacts the roll surface at a point which is 1 to 2 mm before the point at which the laser beam reaches the roll surface. The gas jet forms an angle of approximately 45° with the surface of the roll. The above operating parameters lead to high quality grooves.

While the invention has been particularly shown and described in reference to preferred embodiments thereof, it will be understood by those skilled in the art that changes in form and details may be made therein without departing from the spirit and scope of the invention.

We claim:

1. A method for forming grooves in the surface of a roll for working web-like materials, comprising the steps of:

melting portions in the surface of the roll, made of non-corrosive steel, with a laser beam, wherein the melting step includes the step of setting the focus of the laser beam between 1 mm and 3 mm above the surface of the roll; and forming grooves of not deeper than 10 mm and each with a width of at most 1 mm in the surface of the roll with a pressurized gas jet from an aligned conduit, wherein the step of forming the grooves is at a roll speed of between 1.2 m/min and 1.6 m/min, wherein the step of forming the grooves further includes the steps of:

(a) pre-heating the pressurized gas jet prior to the flowing thereof from the aligned conduit, (b) directing the pre-heated pressurized gas toward the portions in the surface of the roll which have been melted by the laser beam, and (c) blasting the melted portions in the surface of the roll of the grooves with the pre-heated pressurized gas, wherein the blasting step includes the step of blasting the melted portions with the gas having the composition of between 85 and 95 Vol. % of argon, between 2 and 6 Vol. % of oxygen, and between 3 and 7 Vol. % of carbon dioxide.

2. A method according to claim 1, wherein pressurized gas is an inert gas or gas mixture.

3. A method according to claim 1, wherein the pressurized gas is an oxidizing gas or gas mixture.

4. A method according to claim 1, wherein the depths of the grooves are between 3 mm and 7 mm.

5. A method according to claim 1, wherein widths of the grooves are between 0.3 mm and 0.7 mm.

6. A method according to claim 1, wherein the laser beam impinges the surface of the roll perpendicularly.

7. A method according to claim 1, wherein the laser beam impinges the surface of the roll at a defined angle.

8. A method according to claim 1, wherein the laser beam is from a $CO_2$ laser source.

9. A method according to claim 1, wherein the laser beam is from a laser source having a power of at least 1 KW.

10. A method according to claim 1, wherein the laser beam is from a $Co_2$ laser source having a power of at least 5 KW.

11. A method according to claim 1, wherein the roll is rotated with a velocity which effects the required groove depth.

12. A method according to claim 1, wherein a laser source is moved along the rotating roll.

13. A method according to claim 1, wherein the roll is rotated during the formation of the grooves and axially moved to form a helical groove in the surface of the roll.

14. A method according to claim 1, wherein adjacent grooves are spaced apart not further than 10 mm.

15. A method according to claim 1, wherein adjacent grooves are spaced apart by 3 mm.

16. A method according to claim 1, wherein existing shallow grooves are brought to the depth required.

17. A method of claim 1, wherein the surface material of the roll is a non-corrosive steel having the following composition: C <=0.1; Si<=1.0; Mn<=2.0; Cr=16.5-17.5; Mo=2.25; Ni=10.5-13.5; and Fe as balance.

18. A method of claim 1, wherein the power of the laser beam is between 5 kW and 6 kW.

19. A method of claim 1, wherein a focal distance of the laser beam is 300 mm.

20. A method of claim 1, wherein the blasting step includes the step of blasting with the gas in the amount of between 55 $Nm^3$/min. and 60 $Nm^3$/min. having a blowing pressure of substantially 10 bar.

21. A method of claim 1, wherein the blasting step includes the step of impacting the roll surface at a point which is between 1 mm and 2 mm before the point at which the laser beam reaches the roll surface.

22. A method of claim 1, wherein the blasting step includes the step of blasting with the gas at an angle of approximately 45° with the roll surface.

23. A method for forming grooves in the surface of a roll for working web-like materials, comprising the steps of:

melting portions in the surface of the roll, made of non-corrosive steel, with a laser beam, wherein the step of melting includes the step of melting portions in the surface of the roll at a depth of between 3 mm and 7 mm, and at a width of between 0.3 mm and 0.7 mm, wherein the melting step includes the step of setting the focus of the laser beam between 1 mm and 3 mm above the surface of the roll; and forming grooves in the surface of the roll with a pressurized gas jet from an aligned conduit, wherein the step of forming the grooves is at a roll speed of between 1.2 m/min. and 1.6 m/min., wherein the step of forming the grooves further includes the steps of:

(a) directing pressurized gas toward the portions in the surface of the roll which have been melted by the laser beam, and (b) blasting the melted portions in the surface of the roll of the grooves with the pressurized gas, wherein the blasting step includes the step of blasting the melted portions with the gas having the composition of between 85 and 95% of argon, between 2 and 6% of oxygen, and between 3 and 7% of carbon dioxide, and wherein the step of directing the pressurized gas includes the step of directing the pressurized gas from an obliquely positioned nozzle onto the portions in the surface of the roll which have been melted by the laser beam.

* * * * *